United States Patent [19]

Mackal

[11] Patent Number: 4,475,664

[45] Date of Patent: Oct. 9, 1984

[54] AUTOMATIC INFLATOR

[76] Inventor: Glenn H. Mackal, 4923 59 Ave. S., Bayway Isles, St. Petersburg, Fla. 33702

[21] Appl. No.: 402,917

[22] Filed: Jul. 29, 1982

[51] Int. Cl.[3] ..... B63C 9/24

[52] U.S. Cl. ..... 222/5; 222/54; 222/83; 441/95

[58] Field of Search ..... 222/3, 5, 54, 81, 83.5, 222/543, 83, 131; 441/41, 92, 93, 95

[56] References Cited

U.S. PATENT DOCUMENTS

| | | | |
|---|---|---|---|
| 3,266,668 | 8/1966 | Davis | 222/54 X |
| 3,490,648 | 1/1970 | Fujimoto | 222/5 |
| 3,526,339 | 9/1970 | Bernhardt et al. | 222/5 |
| 4,223,805 | 9/1980 | Mackal | 222/5 |
| 4,267,944 | 5/1981 | Mackal | 222/5 |

*Primary Examiner*—Joseph J. Rolla
*Assistant Examiner*—Kevin P. Shaver

[57] ABSTRACT

Automatic inflator which inflates gas-inflatable articles by the release of compressed gas from a gas-containing capsule by the piercing of a seal on the capsule. The inflator has an elongated cup-shaped housing having an open rear end and a generally closed front end. The rear end of the housing receives the neck of a compressed gas-containing capsule with the seal on the capsule disposed within the housing. A plunger is disposed adjacent to the forward, generally closed end of the housing, the plunger being adapted to reciprocate longitudinally of the housing. A piercing pin is mounted on the plunger to confront the seal of a capsule mounted on the housing; there is a spring at the forward end of the housing for constantly urging the plunger and the piercing pin thereon longitudinally rearwardly of the housing toward the seal on the capsule, and a releasable blocking device interposed between the plunger and the neck of the capsule to hold the piercing pin spaced from the seal of the capsule. The blocking device includes a water-sensitive member which when wet releases the blocking device so that the spring moves the piercing pin toward the capsule whereby the seal on the capsule is pierced thereby. The inflator is operable both automatically and manually. In the manual operation a support is manually removable laterally from the housing; the plunger, the support, and the blocking device move together toward the capsule when the inflator is operated automatically so that the piercing pin pierces the seal of the capsule.

9 Claims, 7 Drawing Figures

AUTOMATIC INFLATOR

This invention is related to those of the same inventor which are disclosed in Pat. No. 4,223,805, Sept. 23, 1980; U.S. Pat. No. 4,260,075, Apr. 7, 1981; and U.S. Pat. No. 4,267,944, May 19, 1981.

This invention relates to an automatic inflator for inflatable articles such as life rafts, life vests, and the like. In the disclosed preferred embodiment thereof, the inflator is capable of operation both manually and automatically, the inflator in the latter mode of operation being operated automatically upon its subjection to water, as by being submerged therein when employed with a life vest worn by a ditching or parachuting aviator.

Automatic inflators have been previously proposed. Among such prior disclosed automatic inflators are the following: Muller, U.S. Pat. No. 1,329,990, Spidy, U.S. Pat. No. 2,894,658, Waters, U.S. Pat. No. 3,242,514, Fujimoto, U.S. Pat. No. 3,494,506, and Niemann, U.S. Pat. No. 3,997,079. Of these patents, only those to Fujimoto and Niemann disclose automatic inflators which are also capable of operation manually. In Fujimoto a lever-operated cam, an automatic, water-responsive mechanism, and a gas capsule which is moved toward a stationary piercing pin are arranged in that order. The operation of the inflator manually by the lever-operated cam may well cause operation of the automatic inflator portion of the device, a result which is neither necessary nor desirable. In Niemann, although the automatically operating portion of the device is disposed in series in that order with the manually operating portion thereof and the piercing pin, a part of the automatically operating mechanism is disposed in a first, removable part of the housing and another part of the automatically operating mechanism is disposed in a second part of the housing, the remains therein when the first part of the housing is removed and the inflator is operated only manually. Further, the removal of the first housing part leaves the second housing part in open condition, vulnerable to its being fouled both by physical and atmospheric agencies.

The above three referred-to Mackal patents have overcome to a substantial extent the outlined disadvantages of the prior art, and have provided an automatically operated mechanism, responsive to being immersed in water, to effect a piercing of a gas-containing capsule, which may be easily attached to and held securely as a part of a manually operable inflator which by itself is complete. The inflator of the present invention represents an improvement, not only over the above-noted prior art of others, but also over the invention of the prior Mackal patents. The inflator of the present invention is of simpler, more compact construction than prior inflators, is more economically made, and is more simply manipulated when operated in its manual mode. The gas-containing capsule is not limited in size, because only the neck thereof is contained within the housing of the inflator. The moisture-responsive latching mechanism which makes the automatic operation of the inflator possible is readily replaceable; the inflator has a good $CO_2$ seal; and the fact that the inflator has been manually operated is readily ascertainable from the fact that the manual firing mechanism, in the nature of an insertable fork, will have been removed from the inflator. Finally, the inflator of the invention is so constructed that it permits the fact that the inflator has been automatically operated to be quickly and accurately ascertained from the external appearance of the inflator.

The invention will be more readily understood upon consideration of the accompanying drawings, in which.

Figure 7:
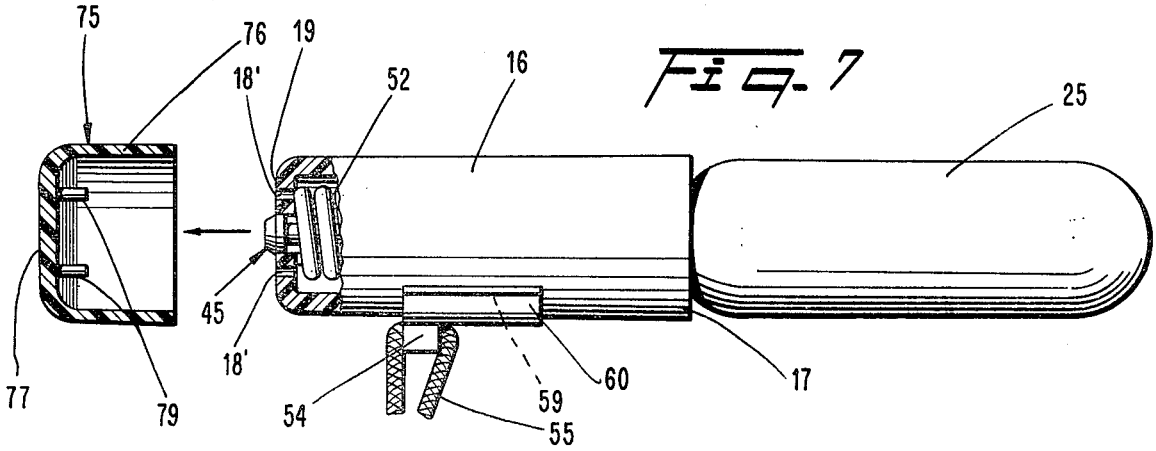
Figure 4:
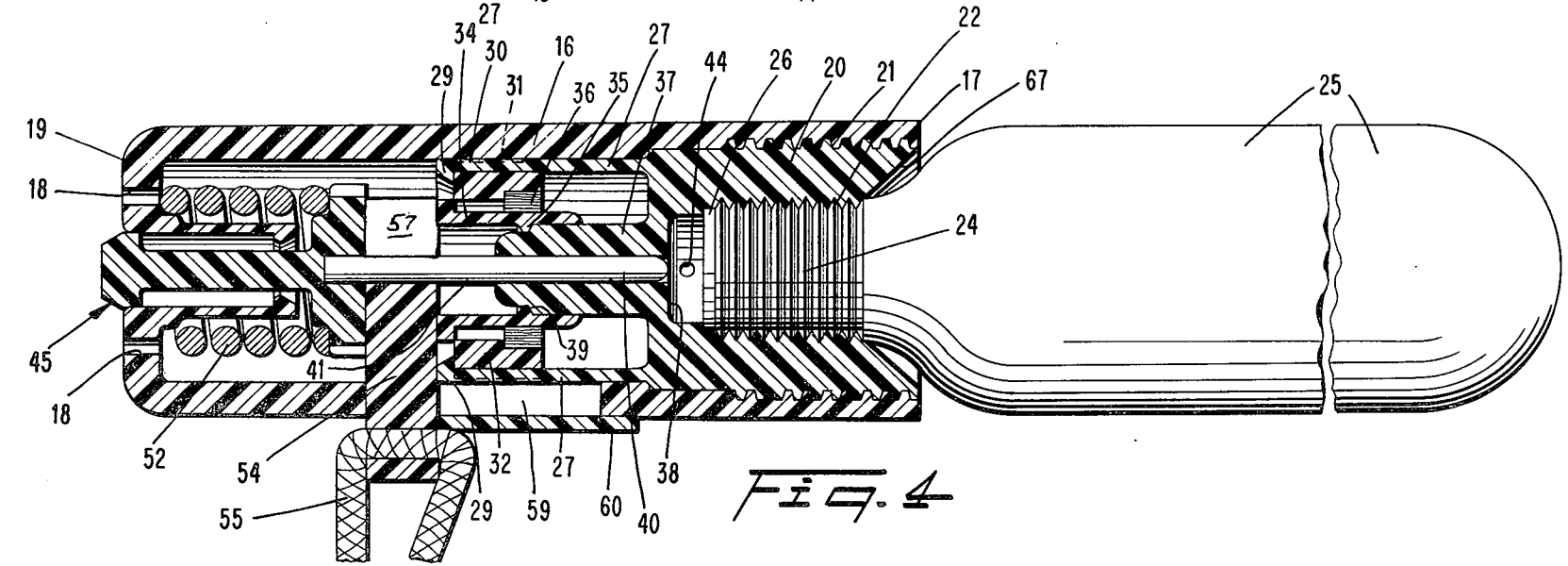
FIG. 4 is a view similar to FIG. 3 but with the sectioning plane displaced 90° about the axis of the inflator from that of FIG. 3.
Figure 6:
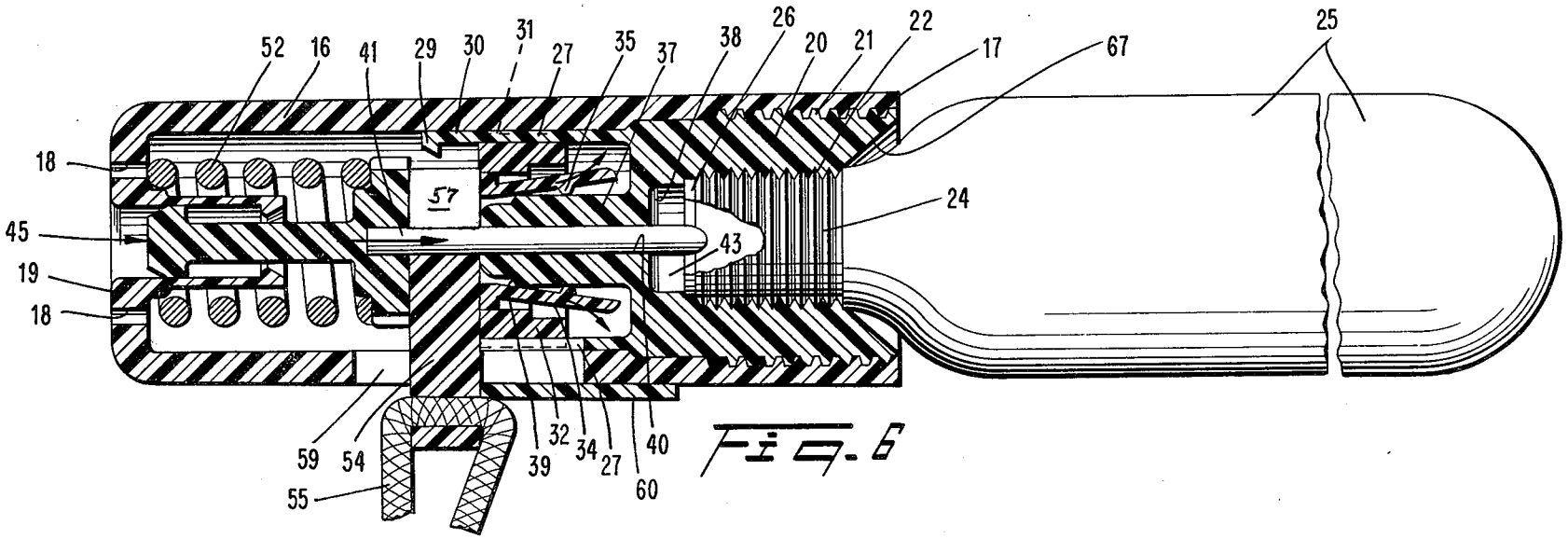

FIG. 6 is a view similar to FIG. 4 but with the inflator in the condition which it assumes after it has been automatically fired or discharged; and FIG. 7 is a view in side elevation on a reduced scale of an alternative embodiment of the inflator of the invention, a portion of the inflator being shown in axial section, a rain cap for the inflator being shown in exploded relation with respect thereto.

Figure 1:
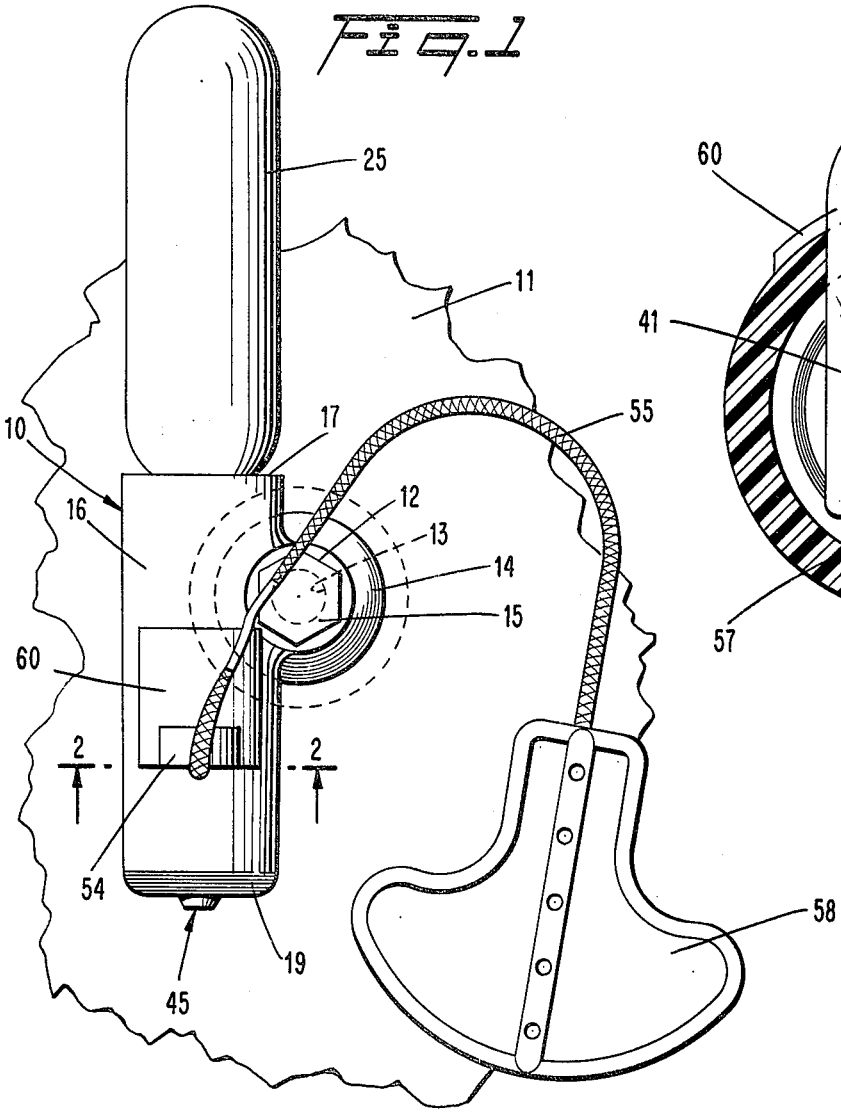
FIG. 1 is a view in side elevation of a preferred embodiment of the automatic inflator of the invention, such inflator being shown attached to a portion of the wall of an inflatable article.

FIG. 1 shows a preferred embodiment of inflator 10 in accordance with the invention, the inflator being attached and sealed to the side wall 11 of an inflatable article by way of a stem 12 which is received within a D-shaped passage 13 in a side enlargement or fitting on the housing of the inflator. The stem 12 is secured and sealed to the part 14 of the housing by means including a cap nut 15. The part 14 is formed integrally with the body 16 of the inflator. The body 16 is generally in the form of an elongated cup having an open rear end 17 and a transverse wall 19 at its other, forward end. A plurality of axially extending opening 18 are distributed around the front end wall 19 coaxial thereof. Such openings 18 allow the ingress of water into the interior of the housing 16 when the inflator is submerged in water.

Figure 3:
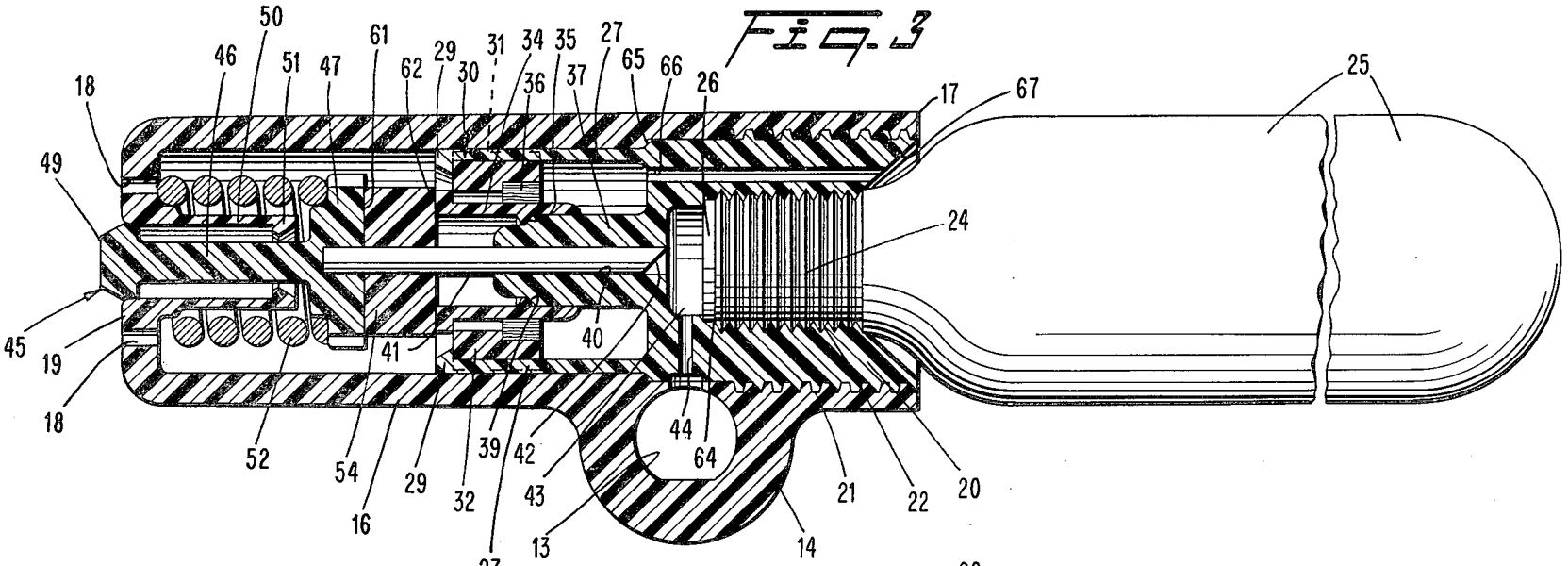
FIG. 3 is a view in longitudinal axial section through the inflator, the inflator being shown in cocked condition.

Turning now to FIGS. 3 and 4, it will be seen that the rear or right end of the housing 16 is internally threaded at 21, and that a sleeve 20 having an externally threaded rear end portion is threaded into it. The sleeve 20 has an internally threaded axially extending passage which threadedly receives the threaded neck 24 of a $CO_2$ capsule 25. Capsule 25 has a frangible seal 26 across the end of the neck 24, the piercing of the seal 26 releasing the gaseous contents of the capsule 25 and inflating the article to the side wall of which the inflator is connected.

To the forward end of the sleeve 20 there are connected a plurality of angularly spaced axially extending struts 27, each of such struts having a radially inwardly extending abutment 29 at its forward end. As shown, the rear surfaces of the abutments 29 are disposed in a plane extending transversly of the longitudinal axis of the housing 16.

A selectively releasable annular blocking member or bobbin 30 is mounted within the forward end portions of the struts 27, the struts being received within longitudinally extending grooves 31 in the outer periphery of the annular main body 32 of the bobbin. The radially outer edge of the forward transverse annular surface of the main body 32 abuts and transverse rear surfaces of the abutments 29 on the struts 27.

The blocking member or bobbin 30 is constructed in a manner which is generally similar to that of the latching means 61 disclosed in Mackal U.S. Pat. No. 4,260,075. Thus a plurality of angularly spaced fingers 34 extend rearwardly from the annular body 32, each of fingers 34 having a radially inwardly extending tooth 35, the teeth 35 being transversely aligned. A water-disintegrable annular member 36 surrounds the fingers 34 and maintains the fingers in the position shown in FIGS. 3, 4, and 5 until it is disintegrated upon contact with water, whereupon the fingers 34 spread, as shown in FIG. 6 to be described hereinafter.

Figure 5:
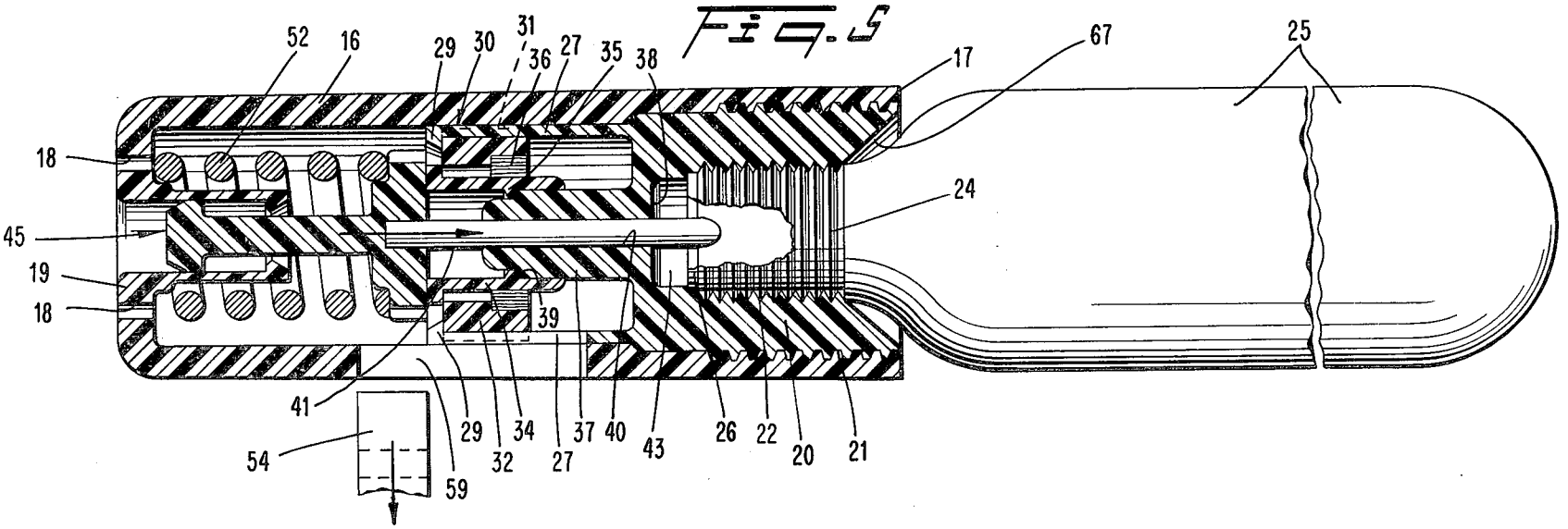
FIG. 5 is a view in longitudinal axial section through the inflator taken in a manner similar to that of FIG. 4, the inflator being shown in FIG. 5 in the condition which it assumes after having been manually operated or discharged.

The sleeve 20 has a transversely extending portion 38 at the forward end of its main, thicker portion, part 38 serving to support an axially forwardly extending hollow central stem member 37, which is formed integrally with parts 20 and 38. As shown in FIGS. 3, 4, and 5, the forward end of the stem 37 is received within the ends of fingers 34 which extend rearwardly of the teech 35, there being a forwardly converging frusto-conical annular surface 39 near the forward end of the stem 37, surface 39 mating with the slanting rear surfaces of the teeth 35 on the fingers 34. The stem 37 has an axially extending central bore 40 therein, bore 40 slidingly but snugly and accurately receiving therewithin a solid axially extending piercing pin 41. Piercing pin 41 has a sharpened slanting rear end 42 which, when the parts are disposed as shown in FIGS. 3, and 4, is spaced forwardly of the seal 26 on the neck of the $CO_2$ capsule 25. When the piercing pin 41 is moved to the rear, whether manually or automatically, it pierces the seal 26, thereby permitting escape of the gas in capsule 25. When the sleeve 20 is screwed into its innermost position within the housing 16, as determined by engagement of shoulders on the respective parts 16 and 20 at 65, a radial passage 44 in the sleeve 20 connects the space 43 within the sleeve 20 with the interior of the enlargement 14 on housing 16 and thus with the interior of the stem 12 which is disposed within the passage 13 in the enlargement 14.

The forward end of the piercing pin 41 is connected to a plunger, generally designated 45, such plunger having a stem 46 and an enlarged cross head 47 connected to the rear end of the stem 46. The plunger has an enlarged head 49 on its forward end, head 49 being slidably received within a central axially extending guide sleeve 50 which is formed integrally with the rear end member 19 of the housing 16. The rear end of the guide sleeve 50 has a thickened radially inwardly extending annular member 51 which also serves to guide the stem 46. A coil compression spring 52 is disposed between a forward spring seat on the housing at the junction between the transverse wall 19 and the guide sleeve 50, and a rear spring seat on the forward surface of the cross head 47. In FIGS. 3, and 4, the coil compression spring 52 is shown in its fully compressed state.

Figure 2:
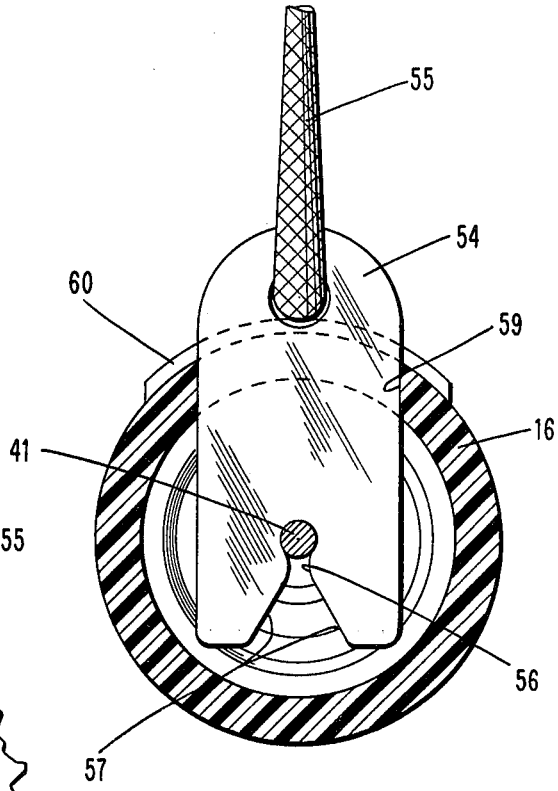
FIG. 2 is a view in transverse section on an elongated scale through the inflator of FIG. 1, the section being taken along the line 2—2 in FIG. 1.

In FIGS. 3 and 4, the rearwardly directed thrust imposed upon the cross head 47 by the spring 52 is opposed by a withdrawable support or yoke 54 having a forward surface 61 which engages the cross head 47 and a rear surface 62 which engages the forward surface of the body 32 of the bobbin or blocking member 30. Such latching member 30 in turn is held from movement to the rear by reason of engagement between its teeth 35 with the surface 39 on the stem 37 of the sleeve 20. As shown most clearly in FIG. 2, the support or yoke 54 as a parallel-sided slot 56 at its inner end, a slanting-sided funnel-like opening 57 leading into the slot 56. The slot 56 receives the shank of the piercing pin 41 within it. A flexible lanyard 55 is secured to the outer end of the yoke 54, the lanyard being provided with a handle 58 so that it may be strongly pulled in a radially outward direction to remove the yoke 54 from the housing 16.

Because in the automatic mode of operation of the inflator the yoke 54 moves axially rearwardly of the housing 16, the slot 59 in the side wall of the housing 16 is axially elongated as shown in FIG. 4, whereby to allow the yoke to move from the position shown in FIG. 4 to the position shown in FIG. 6. A partcircular guard or cover 60, integrally attached to the yoke 54, covers the slot 59 when the yoke is in the position thereof shown in FIGS. 3 and 4.

It will be assumed that initially the parts 16, 20, and 30 are not initially connected. The spring 52 will then be in its uncompressed extended position. A bobbin or blocking member 30 is then mounted within the forward ends of the struts 27 by being thrust axially rearwardly within them until the main body 32 of the bobbin snaps past the transverse surface of the abutments 29 on the struts 27. A $CO_2$ capsule 25 is then screwed into the sleeve 20, the capsule neck bottoming at the annular surface 64 within the sleeve 20. The capsule 25, the sleeve 20, and the parts 37 and 38 integrally attached to the sleeve 20 then act as a single member. Thereupon, using the capsule 25 as a handle, the sleeve 20 can be threaded into the threaded rear end portion 17 of housing 16. Ordinarily, in order to avoid maintaining the watersensitive ring or annulus 36 under undue stress, the sleeve 20 will be left only preliminarily screwed into the housing 16.

When it is desired to ready the inflator for operation, the capsule 25 and the parts attached thereto, again using the capsule as a handle, are then screwed into the housing 16 until they reach the positions shown in FIGS. 3, 4, 5, and 6. The coil compression spring 52 will then be fully compressed, and the inflator will be in ready-to-fire condition.

MANUAL OPERATION

When it is desired to operate the inflator manually, the support or yoke 54 is withdrawn laterally from the housing 16 by pulling upon the handle 58 and thus the lanyard 55. Upon the removal of the yoke 54 from the housing, as depicted in FIG. 5, the plunger 45 and the piercing pin 41 move to the rear for a distance equal to the axial thickness of the now-removed yoke 54, thereby permitting the rear, piercing end of the piercing pin 41 to punch a hole in the frangible sealing means 26 on the neck of the $CO_2$ capsule. The terminus of the rearward travel of the stem 45 and of the piercing pin 41 is determined by engagement between surface 61 on the cross head 47 and the surface 62 on the forward end of the bobbin 30 as shown in FIG. 5.

AUTOMATIC OPERATION

This operation is depicted in FIG. 6. As above explained, in this operation the yoke 54 remains in place. The rearward travel of the stem 45, the piercing pin 41, and the yoke 54 is now permitted because water entering into the housing 16 causes the destruction of the water-destructible annular member 36 so that the fingers 34 are sprung radially outwardly and the bobbin 30 travels rearwardly with respect to the stem 37. Water reaches the destructible annular members 36 by entering through the openings 18 as well as through one or more longitudinally-directed passages 66 in the sleeve 20 (FIG. 3). The outer end of the passage or passages 66 open upon a frusto-conical surface 67 of the sleeve 20, surface 67 being spaced from the root of the neck of the fully screwed in $CO_2$ capsule 25.

In FIG. 7 there is shown an optional rain shield 75 which may be employed with the inflator of the invention, whereby to lessen the chance of the unwanted destruction of the water-sensitive annulus 36. Shield 75 is cup-shaped, having a sleeve-like sidewall 76 and a closed end wall 77. The holes 18[1] in the wall 19 at the end of the housing 16 are, in this case, of hexagonal shape. Such holes receive round plugs 79 which are integrally attached to the end wall 77 of the rain shield 75. The engagement between plugs 79 and openings 18[1], and between the inner surface of the sidewall 76 of the rain guard 75 and the outer surface of the housing 16 are such as to allow the escape of air from the interior of the housing 16 therebetween. In such case, when the rain guard or shield 75 is placed on the housing 16, water will enter an immersed inflator through the one or more passages 66 provided in the sleeve member 20, so that water will then quickly fill the space within the housing 16 rearwardly of the destructible annular member 36, whereupon such member disintegrates and the inflator operates automatically, as depicted in FIG. 6.

The inflator of the invention is so constructed that it permits the fact that the inflator has been automatically operated to to quickly and accurately ascertained from the external appearance of the inflator. Thus when the support or yoke 54 is absent, having been withdrawn as depicted in FIG. 5, and the stem 45, which may be made of plastic material have a distinctive color, has traveled inwardly of the guide sleeve 50 it can be immediately ascertained that the $CO_2$ capsule 25, which is still in place, has been pierced and the contents thereof have been discharged.

When the inflator has been automatically discharged, as shown in FIG. 6, the plunger 45 will have traveled axially rearwardly somewhat within the guide sleeve 50, as in the case of manual discharge (FIG. 5) but to distinguish the automatic discharge from manual discharge the yoke or support 54 remains in place but has been shifted rearwardly of the housing 16. This is a condition which occurs only when, with the yoke or support 54 in place, the yoke 54 has traveled so that its rear surface engages the forward end surface of the hollow stem 37.

As indicated in the drawings, the parts of the housing of the inflator as well as those of the latching mechanism for automatic operation and the removable abutment for manual operation are preferably made of plastic material. A suitable strong shock resistant plastic material for example, may be an acetal resin, such as that marketed by DuPont under the trademark "DELRIN".

Although the invention as illustrated and described with reference to one preferred embodiment thereof, it is to be expressly understood that it is in no way limited to the disclosure of such preferred embodiment but is capable of numerous modifications within the scope of the appended claims.

I claim:

1. An automatic inflator which inflates gas-inflatable articles by the release of compressed gas from a gas-containing capsule by the piercing of a sealing means on the capsule, comprising an elongated cup-shaped housing having an open rear end and a generally closed front end, the rear end of the housing receiving the neck of a compressed gas-containing capsule with the sealing means on the capsule disposed within the housing, a plunger disposed adjacent to the forward, generally closed end of the housing, the plunger being adapted to reciprocate longitudinally of the housing, a piercing pin mounted on the plunger resilient means at the forward end of the housing for constantly urging the plunger and the piercing pin thereon longitudinally rearwardly of the housing toward the sealing means of the capsule, and a releasable blocking means interposed between the plunger and the neck of the capsule to hold the piercing pin spaced from the sealing means of the capsule, the blocking means including a water-sensitive means which when wet releases the blocking means so that the resilient means moves the piercing pin toward the capsule whereby the sealing means on the capsule is pierced thereby, the blocking means comprising cooperating members having telescopically disposed inner and outer parts disposed with their axes aligned longitudinally of the housing, one of said members of the blocking means engaging the capsule and the other of said members of the blocking means being disposed in thrust transmitting relationship with the plunger.

2. An automatic inflator according to claim 1, comprising a supporting means interposed between one of said members of said inner and outer parts of the blocking means and the plunger.

3. An automatic inflator which inflates gas-inflatable articles by the release of compressed gas from a gas-containing capsule by the piercing of a sealing means on the capsule, comprising an elongated cup-shaped housing having an open rear end and a generally closed front end, the rear end of the housing receiving the neck of a compressed gas-containing capsule with the sealing means on the capsule disposed within the housing, a plunger disposed adjacent to the forward, generally closed end of the housing, the plunger being adapted to reciprocate longitudinally of the housing, a piercing pin mounted on the plunger, resilient means at the forward end of the housing for constantly urging the plunger and the piercing pin thereon longitudinally rearwardly of the housing toward the sealing means on the capsule, and a releasable blocking means interposed between the plunger and the neck of the capsule to hold the piercing pin spaced from the sealing means of the capsule, the blocking means including a water-sensitive means which when wet releases the blocking means so that the resilient means moves the piercing pin toward the capsule whereby the sealing means on the capsule is pierced thereby, the blocking means comprising cooperating members having telescopically disposed inner and outer parts disposed with their axes aligned longitudinally of the housing, one of said members of the blocking means engaging the capsule and the other of said members of the blocking means being disposed in thrust transmitting relationship with the plunger, a supporting means interposed between one of said members of said inner and outer parts of the blocking means and the plunger, the inflator being operable both automatically and manually, the supporting means being a member which is manually removable from the housing to operate the inflator manually, and the plunger and the blocking means moving together toward the capsule when the inflator is operated automatically so that the piercing pin pierces the sealing means of the capsule.

4. An inflator which inflates gas-inflatable articles by the release of compressed gas from a gas-containing capsule by the piercing of a sealing means on the capsule, comprising an elongated cup-shaped housing having an open rear end and a generally closed front end, the rear end of the housing being threaded and receiving a longitudinally disposed internally threaded sleeve, the internal threads on the sleeve receiving the neck of a compressed gas-containing capsule with the sealing means on the capsule disposed within the housing, a plunger disposed adjacent to the forward, generally closed end of the housing, the plunger being adapted to reciprocate longitudinally of the housing, a piercing pin mounted on the plunger to confront the sealing means of the capsule mounted on the sleeve, resilient means at the forward end of the housing for constantly urging the plunger and the piercing pin thereon longitudinally rearwardly of the housing toward the sealing means on the capsule, and a releasable blocking means interposed between the plunger and a member forming a part of the sleeve, to hold the piercing pin spaced from the sealing means of the capsule, a supporting means interposed between the plunger and the said part connected to the sleeve, whereby removal of the supporting means releases the blocking means so that the resilient means moves the piercing pin toward the capsule whereby the sealing means on the capsule is pierced thereby, the supporting means being a yoke which is manually removable laterally from the housing through an opening in the side wall thereof, said yoke having a central slot within which the piercing pin is received when the yoke is in place in the inflator.

5. An inflator which inflates gas-inflatable articles by the release of compressed gas from a gas-containing capsule by the piercing of a sealing means on the capsule, comprising an elongated cup-shaped housing having an open rear end and a generally closed front end, the rear end of the housing being threaded and receiving a longitudinally disposed internally threaded sleeve, the internal threads on the sleeve receiving the neck of a compressed gas-containing capsule with the sealing means on the capsule disposed within the housing, a plunger disposed adjacent to the forward, generally closed end of the housing, the plunger being adapted to reciprocate longitudinally of the housing, a piercing pin mounted on the plunger to confront the sealing means of the capsule monted on the sleeve, resilient means at the forward end of the housing for constantly urging the plunger and the piercing pin thereon longitudinally rearwardly of the housing toward the sealing means on the capsule, and a releasable blocking means interposed between the plunger and a member forming a part of the sleeve to hold the piercing pin spaced from the sealing means of the capsule, a supporting means interposed between the plunger and the member forming a part of the sleeve, whereby removal of the supporting means releases the blocking means so that the resilient means moves the piercing pin toward the capsule whereby the sealing means on the capsule is pierced thereby.

6. An inflator according to claim 5, wherein the housing has a side enlargement on the wall thereof, said enlargement having a passage therein to receive a hollow inflating stem attached to the inflatable article, and a radial passage through the sleeve and the wall of the housing to permit travel of the gas released from the capsule therethrough and into the inflating stem.

7. An automatic inflator which inflates gas-inflatable articles by the release of compressed gas from a gas-containing capsule by the piercing of a sealing means on the capsule, comprising an elongated cup-shaped housing having an open rear end and a generally closed front end, the rear end of the housing receiving the neck of a compressed gas-containing capsule with the sealing means on the capsule disposed within the housing, a plunger disposed adjacent to the forward, generally closed end of the housing, the plunger being adapted to reciprocate longitudinally of the housing, a piercing pin mounted on the plunger to confront the sealing means of a capsule mounted on the housing, resilient means at the forward end of the housing for constantly urging the plunger and the piercing pin thereon longitudinally rearwardly of the housing toward the sealing means on the capsule, and a releasable blocking means interposed between the plunger and the neck of the capsule to hold the piercing pin spaced from the sealing means of the capsule, the blocking means including a water-sensitive means which when wet releases the blocking means so that the resilient means moves the piercing pin toward the capsule whereby the sealing means on the capsule is pierced thereby, the blocking means comprising cooperating members having telescopically disposed inner and outer parts disposed with their axes aligned longitudinally of the housing, one of said members of the blocking means engaging the capsule and the other of said members of the blocking means being disposed in thrust transmitting relationship with the plunger, the member bearing the inner part of the blocking means being attached to the capsule neck and the member bearing the outer part of the blocking means being disposed in thrust transmitting relationship with the plunger.

8. An automatic inflator according to claim 7, wherein the inner part of the blocking means has a transverse surface thereon, and the outer part of the blocking means is in the form of a sleeve made up of a plurality of axially extending segments having teeth on the inner surface adapted releasably to engage the transverse surface on the inner part of the blocking means, the segments of the sleeve are mounted for being swung radially outwardly to free the teeth from engagement with the transverse surface, and the water sensitive means is a water-destructible ring disposed around the segments to hold the teeth thereon in engagement with said transverse surface.

9. An automatic inflator according to claim 8, comprising means engaging the outer surface of the ring in locations between the segments of the sleeve to hold the ring in compression in the spans thereof between such means and successive segments of the sleeve.

* * * * *